US012077920B2

(12) United States Patent
Bertz et al.

(10) Patent No.: US 12,077,920 B2
(45) Date of Patent: Sep. 3, 2024

(54) TAMPER STROKE ADJUSTMENT

(71) Applicant: JOSEPH VOEGELE AG, Ludwigshafen/Rhein (DE)

(72) Inventors: Klaus Bertz, Dittelsheim-Hessloch (DE); Ralf Weiser, Ladenburg (DE); Tobias Noll, Roschbach (DE); Christian Pawlik, Neustadt (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 101 days.

(21) Appl. No.: 17/575,687

(22) Filed: Jan. 14, 2022

(65) Prior Publication Data

US 2022/0220675 A1 Jul. 14, 2022

(30) Foreign Application Priority Data

Jan. 14, 2021 (EP) ..... 21151610

(51) Int. Cl.
*E01C 19/48* (2006.01)

(52) U.S. Cl.
CPC ..... *E01C 19/486* (2013.01); *E01C 2301/20* (2013.01)

(58) Field of Classification Search
CPC ..... E01C 19/486; E01C 2301/20
See application file for complete search history.

(56) References Cited

U.S. PATENT DOCUMENTS 4,427,358 A 1/1984 Stilwell
4,507,014 A 3/1985 Heims et al.
4,828,428 A 5/1989 Anderson
5,423,628 A 6/1995 Jaworski
5,544,576 A 8/1996 Kato
(Continued)

FOREIGN PATENT DOCUMENTS

CN 101821456 A 9/2010
CN 102107180 A 6/2011
(Continued)

OTHER PUBLICATIONS

European Search Report (with English Machine Translation) dated Jun. 14, 2021, Application No. 21151612.5-1002, Applicant Joseph Voegele AG, 16 Pages.
(Continued)

*Primary Examiner* — Abigail A Risic
(74) *Attorney, Agent, or Firm* — Brooks Kushman P.C.

(57) ABSTRACT

The disclosure relates to a road finishing machine with a screed for producing a paving layer, wherein the screed includes at least one compacting unit for precompacting paving material supplied to the screed. The compacting unit includes at least one eccentric bushing mounted on an eccentric shaft supporting the same at a desired angle of rotation to thereby continuously variably set a desired tamper stroke of a tamper bar of the compacting unit. For rotating the eccentric bushing on the eccentric shaft, an adjusting mechanism mounted spaced apart from the eccentric shaft and at least partially rotatable along with a rotary motion of the eccentric shaft can be activated. Furthermore, the disclosure relates to a method for a continuously variable tamper stroke adjustment at a compacting unit of a road finishing machine.

20 Claims, 8 Drawing Sheets

(56) References Cited

U.S. PATENT DOCUMENTS

| | | | | |
|---|---|---|---|---|
| 7,540,686 | B2 * | 6/2009 | Heims | E01C 19/40 404/102 |
| 8,371,770 | B1 | 2/2013 | Rasmusson et al. | |
| 8,534,955 | B2 | 9/2013 | Buschmann et al. | |
| 8,807,866 | B2 | 8/2014 | Buschmann et al. | |
| 9,039,324 | B2 | 5/2015 | Ackermann et al. | |
| 9,487,924 | B2 | 11/2016 | Bertz et al. | |
| 9,790,648 | B2 | 10/2017 | Buschmann et al. | |
| 10,060,086 | B2 * | 8/2018 | Laugwitz | E01C 19/40 |
| 10,246,834 | B1 * | 4/2019 | Ellwein | E01C 19/48 |
| 10,265,730 | B2 | 4/2019 | Johnsson et al. | |
| 10,472,777 | B1 | 11/2019 | Case | |
| 10,808,362 | B2 | 10/2020 | Seyriehner | |
| 11,401,859 | B2 | 8/2022 | Gutzer | |
| 2002/0168226 | A1 * | 11/2002 | Feucht | E01C 19/407 404/102 |
| 2010/0284743 | A1 | 11/2010 | Stefan | |
| 2011/0123270 | A1 * | 5/2011 | Buschmann | E01C 19/4833 404/133.05 |
| 2011/0229263 | A1 * | 9/2011 | Buschmann | E01C 19/002 404/102 |
| 2017/0183831 | A1 | 6/2017 | Laugwitz | |
| 2022/0220674 | A1 | 7/2022 | Bertz et al. | |
| 2022/0220675 | A1 | 7/2022 | Bertz et al. | |

FOREIGN PATENT DOCUMENTS

| | | | | |
|---|---|---|---|---|
| CN | 102191743 | A | 9/2011 | |
| CN | 101906750 | B | 1/2012 | |
| CN | 102535314 | A | 7/2012 | |
| CN | 102985616 | A | 3/2013 | |
| CN | 104831604 | A | 8/2015 | |
| CN | 110158422 | A | 8/2019 | |
| CN | 110438869 | A | 11/2019 | |
| CN | 216973050 | U | 7/2022 | |
| CN | 217266804 | U | 8/2022 | |
| DE | 3222128 | C2 | 4/1989 | |
| DE | 4307535 | A1 | 9/1994 | |
| DE | 4437958 | A1 | 4/1995 | |
| DE | 102013021494 | A1 | 7/2014 | |
| DE | 102015016777 | A1 | 6/2017 | |
| EP | 0115567 | A1 | 8/1984 | |
| EP | 0941832 | A1 | 9/1999 | |
| EP | 1 905 899 | A2 | 4/2008 | |
| EP | 2366832 | A1 | 9/2011 | |
| EP | 2 599 918 | A1 | 6/2013 | |
| EP | 2 599 919 | A1 | 6/2013 | |
| EP | 3249101 | A1 * | 11/2017 | E01C 19/486 |
| EP | 3 138 961 | B1 | 8/2018 | |
| GB | 659423 | | 10/1951 | |
| JP | S48-10985 | Y | 3/1973 | |
| JP | H2-240306 | A | 9/1990 | |
| JP | H04330972 | A | 11/1992 | |
| JP | 2000001810 | A | 1/2000 | |
| JP | 2007136528 | A1 | 6/2007 | |
| JP | 2011-196175 | A | 10/2011 | |
| SE | 1500069 | A1 | 8/2016 | |
| WO | 2015/179988 | A1 | 12/2015 | |
| WO | 2017084733 | A1 | 5/2017 | |
| WO | 8102593 | A1 | 9/2018 | |
| WO | 2020099056 | A1 | 5/2020 | |
| WO | 2021151462 | A1 | 8/2021 | |

OTHER PUBLICATIONS

Japanese Office Action (with English Machine Translation) dated Jan. 17, 2023, Application No. 2022-000936, 6 Pages.

European Search Report dated Jun. 16, 2021, Application No. 21151610.9-1002, Applicant Joseph Voegele AG, 13 Pages.

Für jede Aufgabe die richtige Einbaubohle, by Joseph Vögele AG, 68146 Mannheim/DE, No. 2400/10/2.1997 (with English machine translation) (21 pages).

Opposition to a European Patent re Patent No. 4029992 (Application No. EP21151612.5), Applicant: Joseph Voegele AG, Notice dated Jan. 15, 2024 (with English machine translation) (56 pages).

Chinese Office Action and Search Report re Chinese Application No. 2022100563167 dated Mar. 15, 2024, Applicant: Joseph Voegele Corporation (with English machine translation) (13 pages).

Opposition to a European Patent re Patent No. 4029991 (Application No. EP21151610.9), Applicant: Joseph Voegele AG, Notice dated Mar. 18, 2024 (with English machine translation) (115 pages).

Chinese Office Action and Search Report re Chinese Application No. 202210056305.9 dated Mar. 20, 2024, Applicant: Joseph Voegele Corporation (with English machine translation) (17 pages).

Chinese Notification to Grant Patent Right for Invention, CN Application No. 2022100563059, Applicant: Joseph Voegle AG, dated Jun. 12, 2024 (with English machine translation) (2 pages).

Chinese Search Report, CN Application No. 2022100563059, Applicant: Joseph Voegle AG, dated Jun. 6, 2024 (with English machine translation) (5 pages).

* cited by examiner

TAMPER STROKE ADJUSTMENT

CROSS-REFERENCE TO RELATED APPLICATIONS

This application claims foreign priority benefits under 35 U.S.C. § 119(a)-(d) to European patent application number EP 21151610.9, filed Jan. 14, 2021, now European patent number EP 4029991 B1, issued May 10, 2023, which is incorporated by reference in its entirety.

TECHNICAL FIELD

The present disclosure relates to a road finishing machine and to a method for a continuous tamper stroke adjustment at a road finishing machine.

BACKGROUND

EP 3 138 961 B1 discloses a road finishing machine whose screed includes a tamper stroke adjusting means. The tamper stroke adjusting means has an adjusting transmission provided between a rotationally driveable eccentric shaft and an eccentric bushing rotatably mounted on the eccentric shaft. The stroke of the tamper bar is set by rotating the eccentric bushing on the eccentric shaft. EP 3 138 961 B1 moreover discloses an adjusting transmission which is provided between the rotationally driveable eccentric shaft and an eccentric bushing mounted on the eccentric shaft in a torque-proof manner, wherein for adjusting the tamper stroke of the tamper bar, the eccentric bushing is shifted over the adjusting transmission transversely to the eccentric shaft. EP 3 138 961 B1 finally discloses an adjusting transmission which includes a toggle mechanism.

In the two first-mentioned solutions above, the eccentric stroke adjustment during the operation of the road finishing machine is a technical challenge. This is in particular due to the fact that an activation or actuation of the adjusting transmission directly mounted on the eccentric shaft between the eccentric bushing and the eccentric shaft is difficult to carry out. The toggle mechanism is constructively rather complex and occupies a lot of space at the screed.

U.S. Pat. No. 8,371,770 B1 discloses a screed with a tamper stroke adjusting means including a threaded rod and a threaded bushing movably mounted thereon. An axial adjustment of the threaded bushing along the threaded rod moves a lever arm mounted at the threaded bushing, the tamper stroke setting at the screed of the road finishing machine depending on the position and orientation of said lever arm.

EP 1 905 899 A2 discloses a screed for a road finishing machine on which a tamper stroke adjusting means is mounted. The tamper stroke adjusting means comprises a bearing support for an eccentric shaft mounted horizontally and movable along a guiding slide on which an eccentric bushing is mounted in a torque-proof manner. By a horizontal displacement of the bearing support, a distance between the eccentric shaft mounted thereon and a tilting axle provided on the screed can be adjusted manually whereby a tamper stroke adjustment is effected.

EP 2 599 918 A1 discloses a method and a device for setting an upper dead center of a stamper bar of a road finishing machine. EP 2 599 919 A1 discloses a further device for a stroke adjustment of a stamper bar of a road finishing machine.

SUMMARY

It is an object of the disclosure to provide a road finishing machine with a tamper stroke adjusting means and a method for a continuous tamper stroke adjustment at a road finishing machine whereby the tamper stroke can be set, by means of simple, constructive technical means, in particular using fewer modules, precisely and continuously variably, mainly during the paving operation of the road finishing machine.

The disclosure relates to a road finishing machine with a screed for producing a paving layer, wherein the screed includes at least one compacting unit for precompacting paving material supplied to the screed, and wherein the compacting unit includes at least one eccentric bushing mounted on an eccentric shaft supporting the same to be rotatable at a desired angle of rotation to thereby continuously variably set a desired tamper stroke of a tamper bar of the compacting unit.

According to the disclosure, an adjusting mechanism mounted spaced apart from the eccentric shaft and at least partially rotating along with a rotary motion of the eccentric shaft is activatable for rotating the eccentric bushing with respect to the eccentric shaft. Since in the disclosure, a self-rotating adjusting mechanism activates, despite its spaced-apart position to the eccentric shaft, the eccentric bushing rotating along on the eccentric shaft for a tamper stroke adjustment, a plurality of advantages result altogether, as will be described below.

The rotation of the eccentric bushing on the eccentric shaft, that means the respective eccentricities of these two components, leads to a phase adjustment by which the desired tamper stroke can be set at the screed. The phase adjustment can be advantageously activated, in particular with low expenditure of force, by means of the adjusting mechanism spaced apart from the eccentric shaft and mainly rotating along itself at the speed of the eccentric shaft. To set the phase adjustment between the eccentric bushing and the eccentric shaft, the adjusting mechanism rotating along can at least temporarily be activated such that the torque driving it at its input side or the speed applied there at its output side, where it provides a coupling to the eccentric bushing, is geared up or down. Thereby, the eccentric bushing coupled to the adjusting mechanism and rotating along on the eccentric shaft can be "slowed down" or "accelerated" corresponding to the transmission ratio activated by means of the adjusting mechanism relative to the rotary motion of the eccentric shaft, whereby the eccentric bushing rotates to a new angular position relative to the eccentric shaft, i.e., performs the phase adjustment activated by means of the adjusting mechanism. Without a separate activation of the adjusting mechanism rotating along, the eccentric bushing rotates at the same speed as the eccentric shaft, i.e., together with it with a constant phase angle.

The term "rotating along" means that the adjusting mechanism or at least a portion of the components provided thereon rotates together with the eccentric shaft, however mounted at a distance thereto, during the operation of the compacting unit. This module rotating along with the eccentric shaft can be activated sensitively, with low expenditure of force for the above-described phase adjustment, that means a change of the angular position of the eccentric bushing positioned on the eccentric shaft, i.e., for varying the tamper stroke. Moreover, the activation of the adjusting mechanism positioned spaced apart from the eccentric shaft can be carried out more precisely. Furthermore, by means of such an adjusting mechanism rotating along, the tamper stroke adjustment can be carried out better in an automated way.

In particular, a power flow branched off from the eccentric shaft itself to the adjusting mechanism for the relative rotation of the eccentric bushing to the eccentric shaft and at least partially causing it to rotate in response to a rotary motion of the eccentric shaft may be present, wherein the adjusting mechanism caused to rotate thereby can be activated such that it manipulates the power flow directed to it between its input and its output such that it results in a phase shift at its output based on which the eccentric bushing is accordingly rotated on the eccentric shaft. The adjusting mechanism can be present, for example, as a hydraulic and/or electromechanical phase adjusting system.

In the disclosure, the desired tamper stroke adjustment is preferably accomplished as a sum of the individual eccentricities of the eccentric shaft and the eccentric bushing rotatably mounted thereon. A phase angle adjusted therebetween can be changed in a quickly responding and very precise manner by means of the adjusting mechanism rotating along, in particular if it is embodied as an electromechanical phase adjuster. As a rotating module, the adjusting mechanism can be excellently activated for a phase adjustment between its input and output ends.

The adjusting mechanism employed in the disclosure is as such based, advantageously in a compact manner, on already existing components or modules of the screed, so that thereby, a high degree of equal parts is possible even at different screed types. Due to its position spaced apart from the eccentric shaft, the eccentric shaft itself can be of a simpler design in view of construction.

As in the disclosure, the adjusting mechanism can preferably be at least partially rotationally driven by the eccentric shaft, an advantageous balance of forces altogether results for the phase adjustment that can be set at it for adjusting the tamper stroke. This in turn leads to the fact that the adjusting mechanism can be easily automated, whereby a better paving result by means of the road finishing machine is possible Preferably, the adjusting mechanism comprises at least one adjusting drive that can be activated for rotating the eccentric bushing and which is rotationally driven as such by means of the rotary motion of the eccentric shaft, and/or at least one adjusting transmission that can be activated for rotating the eccentric bushing and is rotationally driven by means of the rotary motion of the eccentric shaft. The rotary motion of the eccentric shaft is in this embodiment in general the reason for the rotation of the adjusting drive and/or the adjusting transmission. In this variant, the adjusting drive and/or the adjusting transmission is integrated in a drive train branched off from the eccentric shaft in the power flow of which the adjusting drive and/or the adjusting transmission is integrated to rotate along. A sensitive varying of the angle of rotation between the eccentric bushing and the eccentric shaft is here achieved by an actuation of the adjusting drive and/or the adjusting transmission already with low expenditure of force. In particular, the phase shift angle of the adjusting drive and/or adjusting transmission rotating along in the power flow can be more easily adjusted thereby. By this, the adjusting mechanism is better able to rotate the eccentric bushing with respect to the eccentric shaft into any desired tamper stroke adjustment while the paving operation is in progress, i.e., to adjust the tamper stroke between a minimal and a maximal tamper stroke value.

For a compact construction, it is advantageous for the adjusting drive and the adjusting transmission to form a function unit rotating along together. The function unit is then present as a modular phase adjuster which is mounted to rotate along with the speed of the eccentric shaft with respect to it, wherein the adjusting drive can activate the adjusting transmission for a desired phase adjustment so that in response thereto, the eccentric bushing rotates with respect to the eccentric shaft in order to vary the tamper stroke.

As has been described above, in the disclosure, the rotating eccentric shaft can be present with the function of an actuator for the adjusting drive rotating along and coupled thereto and/or the adjusting transmission rotating along, wherein for performing the phase adjustment between the eccentric bushing and the eccentric shaft, the adjusting drive rotating along and/or the adjusting transmission rotating along as such is, apart from its rotation, additionally activatable. The torque picked off by the eccentric shaft can be at least temporarily changed in the drive train branched off from the eccentric shaft by means of the adjusting drive and/or the adjusting transmission rotatably driven therein for setting the desired phase shift angle, so that forces resulting therefrom slow down or accelerate, that means rotate, the eccentric bushing on the eccentric shaft.

By the fact that in the disclosure, the eccentric shaft preferably both serves for driving the tamper bar and can be present for the function of a drive shaft for the adjusting drive rotating along and/or the adjusting transmission rotating along, that it so to speak fulfills a double function, an adjusting force optionally exerted from outside onto the adjusting drive and/or the adjusting transmission for rotating the eccentric bushing can be considerably reduced. Thereby, the components employed for the tamper stroke adjustment can also be constructively reduced, whereby manufacturing costs can be reduced.

The torque continuously picked off, preferably by the eccentric shaft, during the paving operation can be manipulated in the branched-off power flow by means of the adjusting drive rotating along and arranged therein and/or the adjusting transmission rotating along such that, without any high additional introduction of force, an adjusting movement of the eccentric bushing on the eccentric shaft rotating by means of the drive speed is easily possible. An adjusting moment for varying the tamper stroke, that means for changing a vectorial sum of the individual eccentricities of the eccentric bushing and the eccentric shaft, result from the phase adjustment that can be activated by means of the adjusting drive and/or the adjusting transmission. During the performance of the phase adjustment, the eccentric bushing is rotated relatively to the rotary motion of the eccentric shaft into or against a sense of rotation of the eccentric shaft until the eccentric bushing assumes a desired angular position on the eccentric shaft adjusted with respect to its starting position.

Preferably, the adjusting drive rotating along and/or the adjusting transmission rotating along is activatable to adjust an angle of rotation of a machine element rotatably mounted on the eccentric shaft. The machine element permits a constructively easily producible coupling of the adjusting drive and/or the adjusting transmission with the eccentric bushing mounted on the eccentric shaft. The machine element can be present, for example, in the form of a gearwheel or a pulley for a synchronous belt.

In one embodiment, the machine element itself forms the eccentric bushing or is connected to the eccentric bushing by means of an interlocking clutch, for example by means of a claw clutch. The first mentioned alternative results in a construction with a reduced number of parts. The second alternative can be advantageous for service and/or maintenance measures.

For a standardized construction, it is advantageous for at least one further machine element to be provided which is embodied to transmit a rotary motion of the eccentric shaft to the adjusting drive and/or the adjusting transmission. The further machine element is preferably mounted on the eccentric shaft in a torque-proof manner. This is preferably a gearwheel or a pulley for a synchronous belt. For the further machine element, at the adjusting drive and/or at the adjusting transmission, for example on a transmission case of the adjusting transmission or on a housing of the adjusting drive, a complementary coupling member, for example in the form of a gearwheel or a pulley for the synchronous belt, can be mounted in a torque-proof manner.

By means of the further machine element, the transmission of movement or forces from the eccentric shaft to the adjusting mechanism can be performed. A separate activation, for example a hydraulic or electromechanical activation, of the adjusting mechanism caused to rotate, in particular the adjusting drive rotating along and/or the adjusting transmission rotating along, causes the first machine element coupled to its output end and rotatably arranged on the eccentric shaft—and thus also the eccentric bushing—to be phase-adjusted. As soon as the first machine element has assumed the desired angular position, i.e., the desired tamper stroke is set, the above-mentioned separate activation of the rotationally driven adjusting mechanism is stopped. An actual angle of rotation between the eccentric bushing and the eccentric shaft adjusted thereby at the compacting unit is then easily detectable by means of an appropriate sensory mechanism. The adjusting mechanism continuously rotating along during the operation of the compacting unit can be activated again for a subsequently desired phase adjustment, so that a new switching moment occurs at its output end coupled to the eccentric bushing with respect to its input end.

The above-described machine elements for coupling the eccentric shaft with the adjusting mechanism and for coupling the same with the eccentric bushing can be present as a gearwheel, a pulley and/or a chain wheel and thus form standardized, above all inexpensive machine components.

It offers itself, although this is not obligatory, that during an operation of the compacting unit, the adjusting drive and/or the adjusting transmission is rotationally driven at the same speed as the eccentric shaft. For example, equally dimensioned gear/chain wheels or pulleys are employed for this in the drive train between the eccentric shaft and the adjusting mechanism rotationally driven thereby. In particular, during an operation of the compacting unit, the adjusting drive and/or the adjusting transmission can have a different speed from that of the eccentric shaft. A desired tamper stroke can be achieved in that the same transmission is present between the eccentric shaft and the adjusting transmission and between the adjusting transmission and the eccentric bushing. In other words, the eccentric shaft and the adjusting shaft on which the adjusting transmission is mounted can have different speeds; the eccentric shaft and the eccentric bushing not.

It is advantageous for the adjusting drive and/or the adjusting transmission to be actuated hydraulically, electrically and/or mechanically. By means of a hydraulic adjusting drive and/or adjusting transmission, above all, high adjusting forces could be generated. An electrical or electromechanical adjusting mechanism would permit the tamper stroke adjustment within shorter reaction times, that means independent of a hydraulic temperature.

Preferably, the adjusting transmission is a continuously variable mechanical, hydrostatic or electric transmission. Preferably, the adjusting transmission is activatable for setting a desired transmission ratio by means of a mechanical, hydraulic or electric drive anyway present at the screed, i.e., by means of a drive which is furthermore employed for the operation of another working component of the screed. This further contributes to a reduction of the employed components or modules.

In a variant, the adjusting drive includes an activatable servomotor, and/or a servomotor is provided for the adjusting transmission. The servomotor can form, together with the adjusting transmission, a function unit rotating along with the eccentric shaft, wherein the servomotor is activatable for the desired phase adjustment such that it changes the power flow transmitted to the eccentric bushing via the adjusting mechanism rotating along by the adjusting transmission connected thereto. In response thereto, the eccentric bushing rotates on the eccentric shaft into the desired angular position.

Preferably, the adjusting transmission is embodied as a cam mechanism and/or includes a pair of rotating deflection rollers. By this, the adjusting transmission can be embodied to be particularly robust. It is conceivable for the cam mechanism to comprise two cam disks mounted to be adjustable with respect to each other and which can be displaced linearly and/or rotationally with respect to each other. A movement of the cam disks with respect to each other can cause an adjustment of the deflection rollers mounted thereon along cam paths embodied thereon resulting in a phase adjustment.

According to one embodiment of the disclosure, the adjusting transmission provides, for shifting the deflection rollers mounted thereon and rotating along in the power flow, at least one stationarily mounted cam disk. This is mounted at the stationary cam disk for a translatory and/or rotatory displacement to thereby adjust a shifting of the axes of rotation of the deflection rollers rotating along for a phase adjustment.

According to one embodiment, the pair of rotating deflection rollers is mounted, for rotating the eccentric bushing on the eccentric shaft, to be shifted transversely to the eccentric shaft, i.e., transversely to its axis of rotation. The deflection rollers rotating along can be mounted abutting against a sprocket belt or a drive chain which is connected with the machine element rotationally mounted on the eccentric shaft. By means of a displacement of the deflection rollers, a length ratio of the belt or chain sections guided oppositely simultaneously changes, so that in response thereto, the machine element on the eccentric shaft rotates, that means the eccentric bushing is phase-adjusted with respect to the eccentric shaft.

The two deflection rollers rotating along can be rotationally mounted with respect to axes of rotation mounted in parallel and spaced apart from each other. By means of a change of the positioning of the deflection rollers rotating along, in particular a change of the distance between the axes of rotation, an influence can be exerted on the phase adjustment angle by means of which the eccentric bushing lies on the eccentric shaft.

Preferably, a translatory shifting of the deflection rollers rotating along transverse to the axis of rotation of the eccentric shaft on one side of the synchronous belt guided around the deflection rollers or the drive chain leads to an extension of the path which is simultaneously compensated by a shortening of the path on the opposite side of the synchronous belt or the drive chain. Thereby, with low expenditure of force, a rotation of the eccentric bushing on the eccentric shaft can be effected, so that the eccentric bushing assumes a desired angle of rotation on the eccentric shaft for setting the tamper stroke.

In an advantageous variant, the adjusting drive and/or the adjusting transmission is embodied for synchronously adjusting a plurality of eccentric bushings rotationally mounted along the eccentric shaft (overall stroke adjustment), or the adjusting mechanism comprises a plurality of adjusting drives and/or adjusting transmissions for separately adjusting a plurality of eccentric bushings rotationally mounted along the eccentric shaft (individual stroke adjustment). The eccentric bushings installed along a plurality of unit sections can in these variants be adjusted together, that means synchronously with each other, or independently, i.e., individually. By means of independently activatable eccentric bushings, different tamper strokes could be set during a pavement drive via the paving width producible by the screed.

For a synchronous adjustment of the eccentric bushings, the adjusting mechanism can be coupled to an adjusting shaft at its output end. The adjusting shaft can transmit a phase adjustment centrically set by means of the adjusting mechanism synchronously to a plurality of unit sections of the compacting unit, i.e., to eccentric bushings mounted thereon. As an alternative, for each unit section of the compacting unit, an independently activatable adjusting mechanism rotating along can be present. These can be mounted on a common shaft by which they take up one rotary motion of the eccentric shaft each. At its output end, however, different phase adjustments can be adjusted. Preferably, the adjusting shaft or the shaft is mounted in parallel to the eccentric shaft.

According to one embodiment, the adjusting drive and/or the adjusting transmission is activatable for setting the desired angle of rotation of the eccentric bushing by means of a controlling system. The controlling system can be present as an integral part of the adjusting mechanism independent of whether it is employed for an overall stroke adjustment or an individual stroke adjustment. The controlling system can be connected to a vehicle control of the road finishing machine via a CAN-bus system by which the desired tamper stroke or the respective desired tamper strokes can be stored.

In a particularly preferred variant, the controlling system includes, for a dynamic adaption of the angle of rotation of the eccentric bushing, at least one control loop responding to at least one process parameter detectable during the operation of the road finishing machine. By means of the control loop, for example, one can correspondingly respond to a measured material-specific value of the paving material to be installed, for example to a measured temperature of the paving material transported from the material bunker of the road finishing machine to the screed, and/or the produced paving layer, for example to a measured temperature of the paving layer, with an adaption of the angle of rotation between the eccentric bushing and the eccentric shaft to create an optimal paving result.

In one preferred embodiment of the disclosure, the control loop is able to control a dynamic adjustment of the angle of rotation between the eccentric bushing and the eccentric shaft in reaction to a disturbance variable, for example an ambient temperature, for continuously adapting the tamper stroke.

It is conceivable that during the adjustment of the tamper stroke, a set angle of attack of the screed, a paving travel speed of the road finishing machine, a set drive speed of the eccentric shaft, a temperature of compacting plates of the screed and/or measured values of a separate construction vehicle, for example measured values with respect to the produced paving layer which are detected by means of a compacting vehicle driving behind the road finishing machine, are considered.

Preferably, the adjusting mechanism comprises at least one sensor unit embodied for detecting a set phase angle between the eccentric bushing and the eccentric shaft supporting the same and/or for detecting a stroke of the tamper bar. It is conceivable that the adjusting drive comprises at least one sensory unit suitable for this, for example one or more angle sensors, above all when it is present as a servomotor. By this, on the basis of the detected angular position of the motor shaft of the servomotor, the phase adjustment between the eccentric bushing and the eccentric shaft can be derived. By means of the detected phase adjustment, the controlling system can calculate the actual tamper stroke. It is conceivable that the controlling system derives the corresponding actual tamper stroke based on the measured phase adjustment, for example by means of phase characteristics. A phase adjustment detected or varying by means of the sensor unit can be transmitted to the control unit in real time so that it optionally outputs a corresponding control signal to the adjusting drive, in particular the servomotor, based on a comparison of a desired and an actual tamper stroke, to activate a rotation of the eccentric bushing for a tamper stroke adaption by quick response.

The sensor unit could, according to one embodiment, include at least one distance sensor which is embodied to directly measure a set actual tamper stroke of the tamper bar.

In one practical variant, the adjusting mechanism is embodied to be manually adjustable. This can be helpful, above all, for a calibration of the tamper bar at the beginning of the pavement drive. In contrast, an automated operation of the adjusting mechanism can be perfectly employed during the pavement drive.

The disclosure also relates to a method for a continuously variable tamper stroke adjustment at a compacting unit of a road finishing machine, wherein for adjusting the tamper stroke, at least one eccentric bushing is rotated on an eccentric shaft supporting it. According to the disclosure, for rotating the eccentric bushing on the eccentric shaft, an adjusting mechanism mounted to be spaced apart from the eccentric shaft and at least partially rotating along with a rotary motion of the eccentric shaft is activated.

Preferably, the relative rotation between the eccentric bushing and the eccentric shaft results by a power flow derived from the eccentric shaft and causing a rotational movement of the adjusting mechanism or at least parts thereof being at least temporarily geared up or down by means of the adjusting mechanism such that the angle of rotation between the eccentric bushing and the eccentric shaft is changed thereby. That means, here, the torque is derived from the eccentric shaft and transmitted to the adjusting mechanism as a driving torque. In particular an adjusting transmission connected thereto and also rotating along can be activated by means of an adjusting drive for a torque adaption. In this embodiment, the eccentric bushing uniformly, i.e., at the same speed, rotates along on the eccentric shaft without an additional activation of the adjusting drive. By means of a separate activation of the adjusting drive, the adjusting transmission coupled thereto can create a difference velocity between the eccentric bushing and the eccentric shaft bearing it, whereby the eccentric bushing is rotated into a new angular position on the eccentric shaft. By this, the tamper stroke is adjusted. Thereby, the compacting unit can do altogether with a reduced number of mechanical, electric and/or hydraulic components to vary the tamper stroke. Thereby, a practical, inexpensively producible and essentially autonomously operating adjusting means for varying the tamper stroke at the road finishing machine results.

BRIEF DESCRIPTION OF THE DRAWINGS

Advantageous embodiments of the disclosure will be illustrated more in detail with reference to the following figures.

Figure 1:
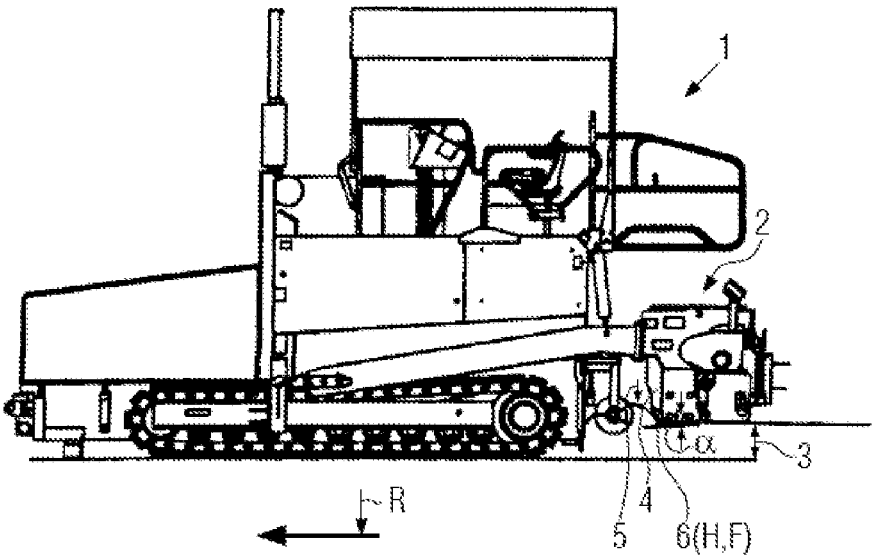
FIG. 1 shows a schematic side view of a road finishing machine.

Equal components are always provided with equal reference numerals in the figures.

DETAILED DESCRIPTION

FIG. 1 shows a road finishing machine 1 with a screed 2 for producing a paving layer 3 in the paving travel direction R. The screed 2 has at least one compacting unit 4 for precompacting a paving material 5 supplied to the screed 2. The compacting unit 4 includes a tamper bar 6 which can be driven with a variable tamper stroke H and/or a variable frequency F for precompacting the paving material 5 supplied to the screed 2.

Figure 2:
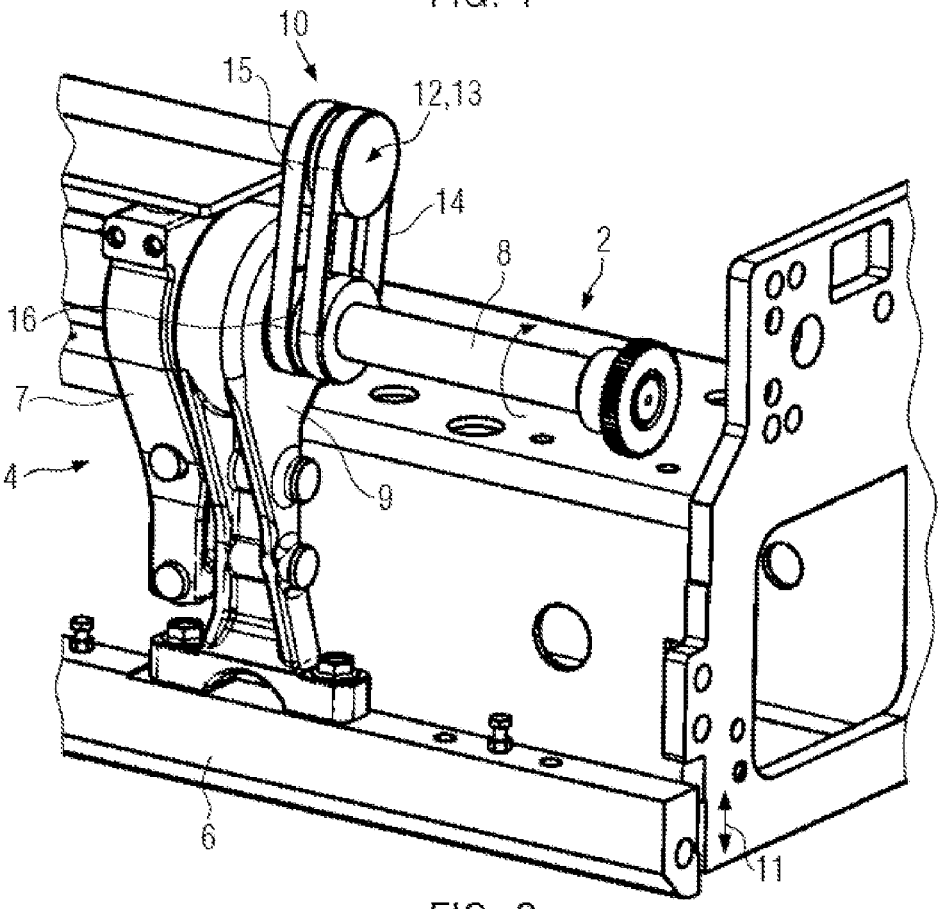
FIG. 2 shows a compacting unit for a screed of a road finishing machine according to a first embodiment.

FIG. 2 shows the compacting unit 4 separately in an enlarged perspective representation. The compacting unit 4 has a bearing support 7 fixed to the screed body and an eccentric shaft 8 rotationally mounted thereto. The eccentric shaft 8 drives a connecting rod 9 to which the tamper bar 6 is fixed.

FIG. 2 furthermore shows an adjusting mechanism 10 which is rotationally driven by means of the eccentric shaft 8. The adjusting mechanism 10 can be activated to set a variable desired tamper stroke 11 for the tamper bar 6. To this end, the adjusting mechanism 10 rotating along comprises an adjusting drive 12 and/or an adjusting transmission 13. According to FIG. 2, the adjusting drive 12 and the adjusting transmission 13 are embodied as a function unit. This function unit is coupled to a rotary motion of the eccentric shaft 8 by means of a synchronous belt 14.

The adjusting mechanism 10 can, without being additionally activated, return the torque, which drives by means of the synchronous belt 14 at its input end and causes it to rotate, to a machine element 16 rotationally mounted on the eccentric shaft 8 by means of a further synchronous belt 15 provided at its output end. By an additional activation of the adjusting mechanism 10, a phase angle of the machine element 16 mounted on the eccentric shaft 8 can be changed. By means of this phase adjustment, an eccentric bushing 17 (see FIG. 2C) rotationally mounted within the connecting rod 9 on the eccentric shaft 8 and coupled to the machine element 16 can be adjusted. According to FIG. 2, for rotating the eccentric bushing 17 on the eccentric shaft 8, the adjusting mechanism 10 mounted spaced apart from the eccentric shaft 8 and rotating along with the rotary motion of the eccentric shaft 8 can be activated.

Figure 2A:
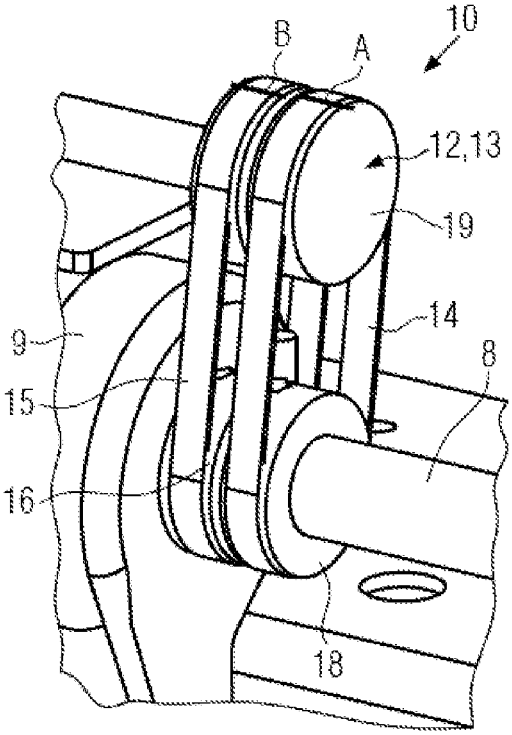
FIG. 2A shows a first operating state of the compacting unit shown in FIG. 2.
Figure 2B:
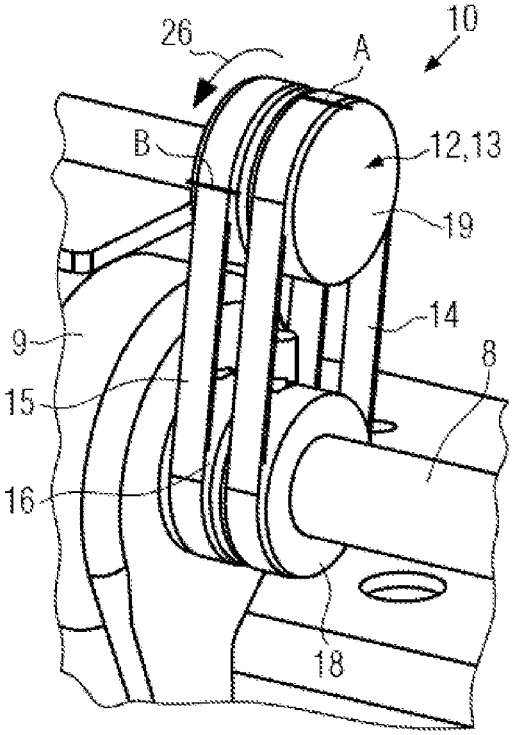
FIG. 2B shows a second operating state of the compacting unit shown in FIG. 2.

With reference to FIGS. 2A and 2B, the performance of a phase adjustment by means of the adjusting mechanism 10 to adjust the tamper stroke 11 is schematically shown.

In FIG. 2A, the synchronous belt 14, which is guided on a pulley 18 mounted on the eccentric shaft 8 in a torque-proof manner, transmits the rotary motion of the eccentric shaft 8 to a housing 19 of the adjusting mechanism 10. The housing 19 can be embodied with a diameter as that of the pulley 18. Thereby, between the eccentric shaft 8 and the adjusting mechanism 10, a belt drive is created which takes care that the adjusting mechanism 10 rotates at the speed of the eccentric shaft 8.

In FIG. 2A, the adjusting mechanism 10 rotating along is not additionally activated, so that a torque applied to its housing 19 at its input end is forwarded to the machine element 16 via the further synchronous belt 15 fixed to its output end. According to FIG. 2A, the consequence of this is that the eccentric bushing 17 mounted within the connecting rod 9 rotates at the speed of the eccentric shaft 8, that means it maintains its angular position with respect to the eccentric shaft 8. FIG. 2A shows this situation schematically by means of the two markings A, B running equally.

In FIG. 2B, the adjusting mechanism 10 has performed a phase adjustment 26 with respect to FIG. 2A. This is shown by means of the two markings A, B now represented shifted with respect to each other. In response thereto, the machine element 16 has rotated with respect to the position shown in FIG. 2A on the eccentric shaft 8 corresponding to the phase adjustment 26. This causes the eccentric bushing 17 coupled to the machine element 16 to also assume an angular position on the eccentric shaft 8 changed by the phase adjustment 26, so that this results, together with the eccentricity of the eccentric shaft 8, in a new desired tamper stroke 11.

Figure 2C:
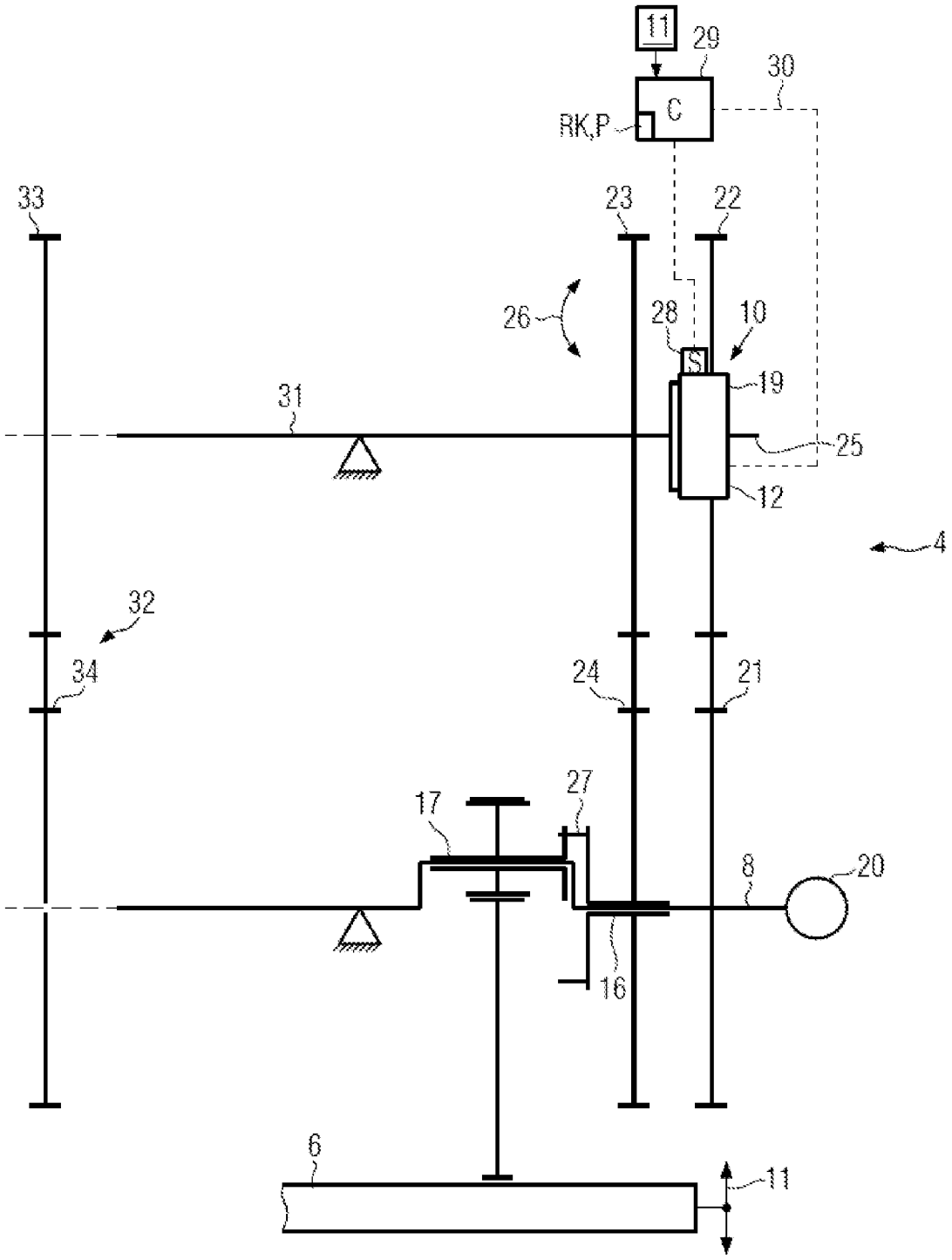
FIG. 2C shows a variant of the first embodiment shown in FIG. 2 for an overall stroke adjustment.

FIG. 2C shows a first variant of the embodiment shown in FIG. 2 for an overall stroke adjustment at the compacting unit 4. This means that a plurality of eccentric bushings 17 positioned along the eccentric shaft 8 are synchronously rotatable by means of the adjusting mechanism 10.

In FIG. 2C, the eccentric shaft 8 is driven by a motor 20. The belt drives represented in FIG. 2 for coupling the eccentric shaft 8 with the adjusting mechanism 10 and for coupling the adjusting mechanism 10 with the machine element 16 are replaced by drive wheels 21, 22 and adjusting wheels 23, 24 in FIGS. 2C and 2D. The drive wheel 21 is mounted on the eccentric shaft 8 in a torque-proof manner. The drive wheel 22 is seated on the housing 19 of the adjusting mechanism 10 in a torque-proof manner. The adjusting mechanism 10 is mounted on a shaft 25 in a torque-proof manner. The adjusting mechanism 10 is configured to perform the phase adjustment 26 between the drive wheel 22 mounted on its housing 19 and the adjusting wheel 23 mounted at its output end. The phase adjustment 26 performed by means of the adjusting mechanism 10 is transmitted from the adjusting wheel 23 to the adjusting wheel 24 and the machine element 16. According to FIG. 2C, the adjusting wheel 24 and the machine element 16 are integrally formed. By means of a rotation of the machine element 16, the eccentric bushing connected thereto by means of a claw clutch 27 in FIG. 2C is rotated on the eccentric shaft 18. Thereby, a change of the (desired) tamper stroke 11 of the tamper bar 6 occurs.

In FIG. 2C, the adjusting mechanism 10 has a sensor unit 28 which is configured to detect the phase adjustment 26 and thus also the angular position of the eccentric bushing 17 on the eccentric shaft 8. The sensor unit 28 transmits its measuring results continuously to a controlling system 29 connected thereto. The controlling system 29 can store the desired tamper stroke 11, the controlling system 29 being configured to calculate an actual tamper stroke from the measured phase adjustment 26 and compare it with the stored desired tamper stroke 11, based on which the controlling system 29 emits a control signal 30 to the adjusting drive 12 of the adjusting mechanism 10. The adjusting drive 12, for example a synchronous motor M rotating along, can then adapt the phase adjustment 26 based on the control signal 20.

The controlling system 29 can include a control loop RK which responds to a process parameter P measured during the operation of the road finishing machine 1, based on which a dynamic adaption of the angle of rotation, that means a dynamic phase adjustment 26, for varying the tamper stroke 11 is possible. The functional principle of the controlling system 29 and/or of the control loop RK is also applicable in connection with all following embodiments.

FIG. 2C furthermore shows that the adjusting mechanism 10 has an adjusting shaft 31 at its output end. According to FIG. 2C, the adjusting wheel 23 is mounted on the adjusting shaft 31 in a torque-proof manner. By this it is possible to transmit the phase adjustment 26 set by means of the adjusting mechanism 10 in FIG. 2C via the adjusting shaft 31 synchronously to another unit section 32. By means of further adjusting wheels 33, 34, an eccentric bushing not shown at the unit section 32 is rotated there analogously synchronously to the eccentric bushing 17.

FIG. 2C thus shows that the adjusting mechanism 10 is embodied, via the adjusting shaft 31, for synchronously adjusting a plurality of eccentric bushings 17 rotationally mounted along the eccentric shaft 8.

Figure 2D:
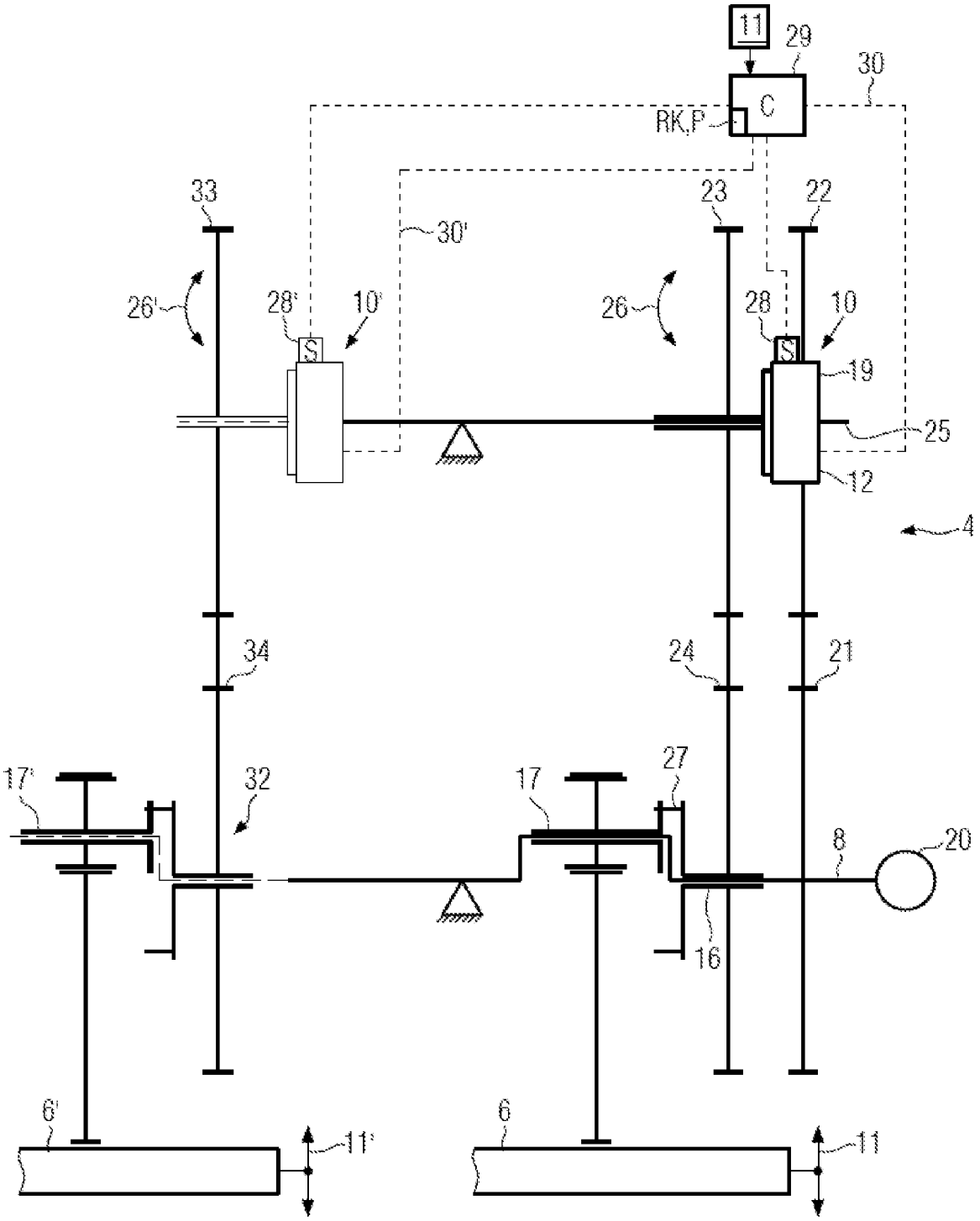
FIG. 2D shows a variant of the embodiment shown in FIG. 2 for an individual stroke adjustment.

FIG. 2D shows a device that is embodied for separately adjusting a plurality of eccentric bushings 17 rotationally mounted along the eccentric shaft 8. By means of this device, an individual stroke adjustment is thus possible.

According to FIG. 2D, the compacting unit 4 comprises the adjusting mechanism 10 for varying the desired tamper stroke 11 of the tamper bar 6, and furthermore an additional adjusting mechanism 10' for the further unit section 32. The adjusting mechanism 10' is driven via the shaft 25 and has a sensor unit 28' by means of which a phase adjustment 26' set at the unit section 32 can be measured on the basis of which the eccentric bushing 17' mounted at the unit section 32 is rotated on the eccentric shaft 8. For an independent actuation of the two adjusting wheels 23, 33, these are rotationally mounted on the shaft 25. It is thus possible to adjust, at the respective unit sections of the compacting unit 4, the desired tamper stroke 11, 11' for the respective tamper bars 6, 6' independently with respect to each other.

Figure 3:
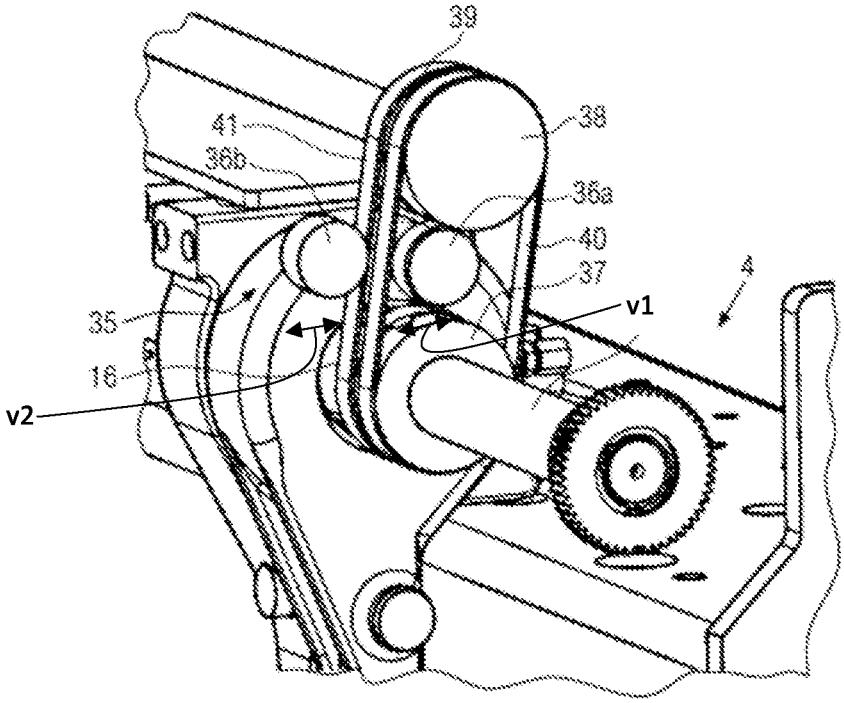
FIG. 3 shows a compacting unit for a screed of a road finishing machine according to a second embodiment.

FIG. 3 shows a second embodiment of the compacting unit 4. The compacting unit 4 furthermore has an adjusting mechanism 35. The adjusting mechanism 35 can be activated to rotate the machine element 16 rotationally mounted on the eccentric shaft 8 such that the desired tamper stroke 11 can be adjusted at the tamper bar 6.

The adjusting mechanism 35 of FIG. 3 has a pair of deflection rollers 36*a*, 36*b* rotating along. The two deflection rollers 36*a*, 36*b* are mounted to be reciprocated transversely to the eccentric shaft 8 which is shown by the double arrows v1, v2. The adjusting mechanism 35 is connected to the rotary motion of the eccentric shaft 8 by means of drive disks 37, 38, 39 mounted in a torque-proof manner by means of synchronous belts 40, 41 guided thereon. The drive disks 38, 39 separately represented in FIG. 3 could also be embodied as one component. A displacement of the two deflection rollers 36*a*, 36*b* transverse to the eccentric shaft 8 causes the machine element 16 connected to the adjusting mechanism 35 via the synchronous belt 41 to rotate on the eccentric shaft 8. The eccentric bushing 17 fixed thereto thereby also changes its angular position on the eccentric shaft 8, so that the (desired) tamper stroke 11 is adjusted.

Figure 3A:
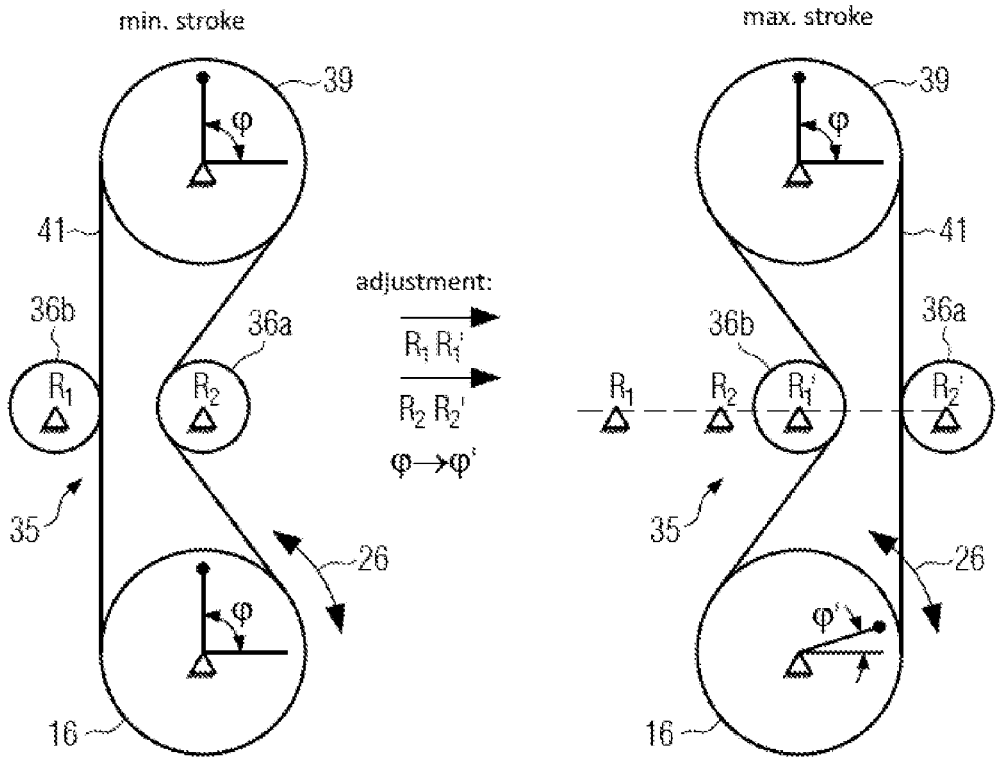
FIG. 3A shows a sectional representation of the adjusting mechanism of the second embodiment shown in FIG. 3.

The functional principle of the phase adjustment by means of the adjusting mechanism 35 is represented in greater detail in FIG. 3A. In the left half of the picture of FIG. 3A, the drive disk 39 and the machine element 16 are both mounted at an angle of rotation φ. For this, the adjusting mechanism 35 assumes a corresponding position according to FIG. 3A. This positioning of the two deflection rollers 36*a*, 36*b* rotating along results in a minimal tamper stroke 11 for the tamper bar 6.

In the right half of the picture of FIG. 3A, the setting of the adjusting mechanism 35 is shown for a maximal tamper stroke 11 of the tamper bar 6. In response to a displacement $\overrightarrow{R1,R1'}$, $\overrightarrow{R2,R2'}$ of the two deflection rollers 36*a*, 36*b*, a new angle of rotation φ resulted for the machine element 16. The displacement of the two deflection rollers 36*a*, 36*b* rotating along transversely to the eccentric shaft 8 driving the same thereby causes the phase adjustment 26 of the machine element 16, whereby the eccentric bushing 17 rotates on the eccentric shaft 8.

Figure 3B:
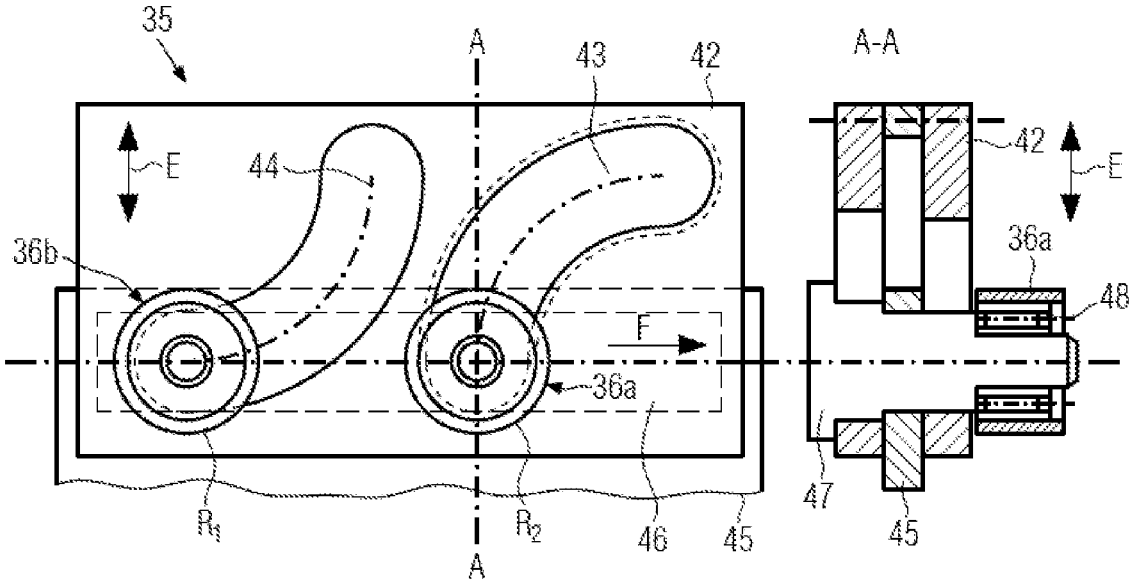
FIG. 3B shows a separate representation of the adjusting mechanism of the embodiment shown in FIG. 3.

FIG. 3B shows a potential construction for the adjusting mechanism 35. The adjusting mechanism 35 includes an adjustably mounted cam disk 42 with a first cam path 43 for the deflection roller 36*a* and with a second cam path 44 for the deflection roller 36*b*. Furthermore, the adjusting mechanism 35 has a stationarily mounted cam disk 45 with a guide path 46 for the deflection rollers 36*a*, 36*b*. By means of a displacement of the cam disk 42 in the direction E, the two deflection rollers 36*a*, 36*b* are shifted together in the direction E in the guide path 46. By the displacement of the two deflection rollers 36*a*, 36*b*, the phase adjustment 26 takes place at the machine element 16 whereby the eccentric bushing 17 rotates on the eccentric shaft 8.

Furthermore, FIG. 3B shows a section A-A in its right picture half. The deflection roller 36*a* is mounted on a bolt 47. To reduce a frictional resistance, the deflection roller 36*a* is fixed to the bolt 47 by means of a rolling bearing 48.

Figure 3C:
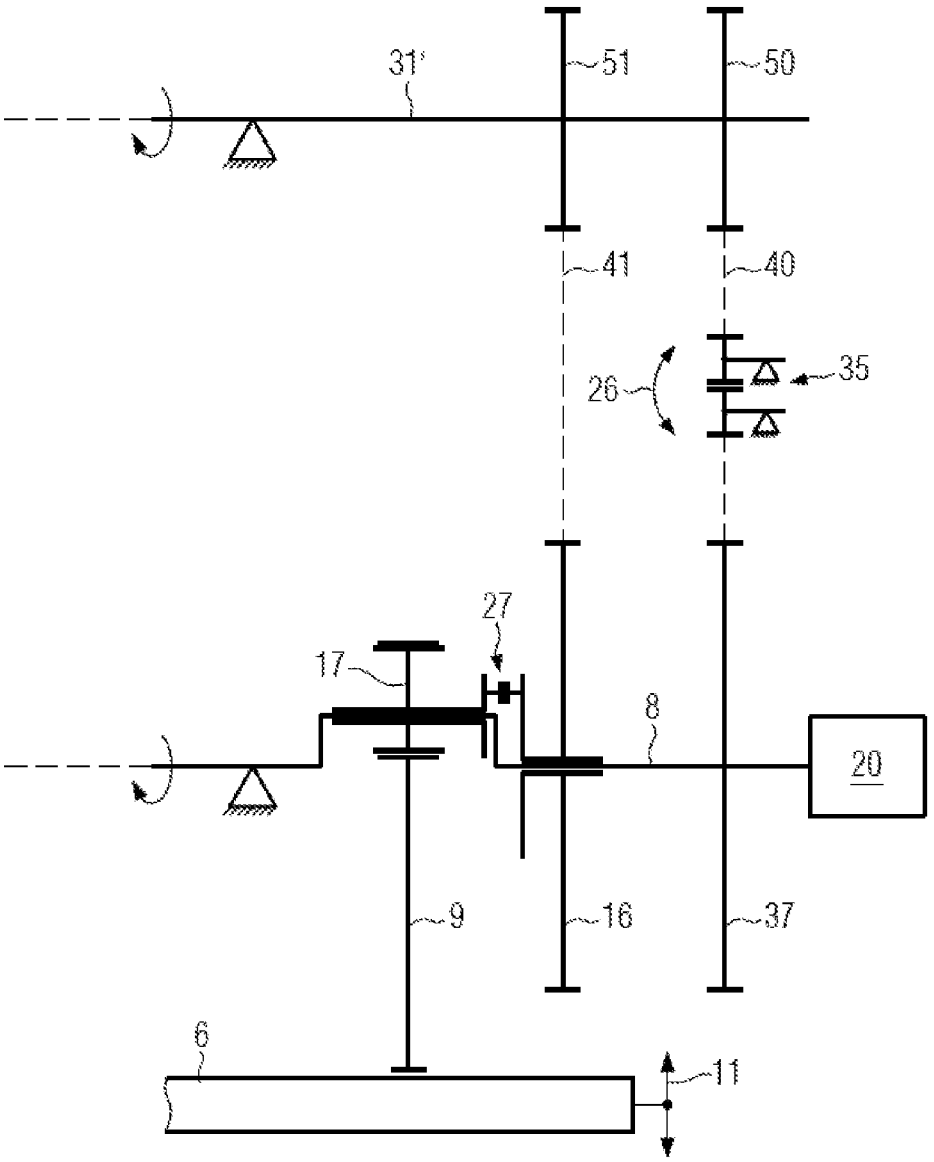
FIG. 3C shows a variant of the second embodiment shown in FIG. 3 for an overall stroke adjustment.
Figure 3D:
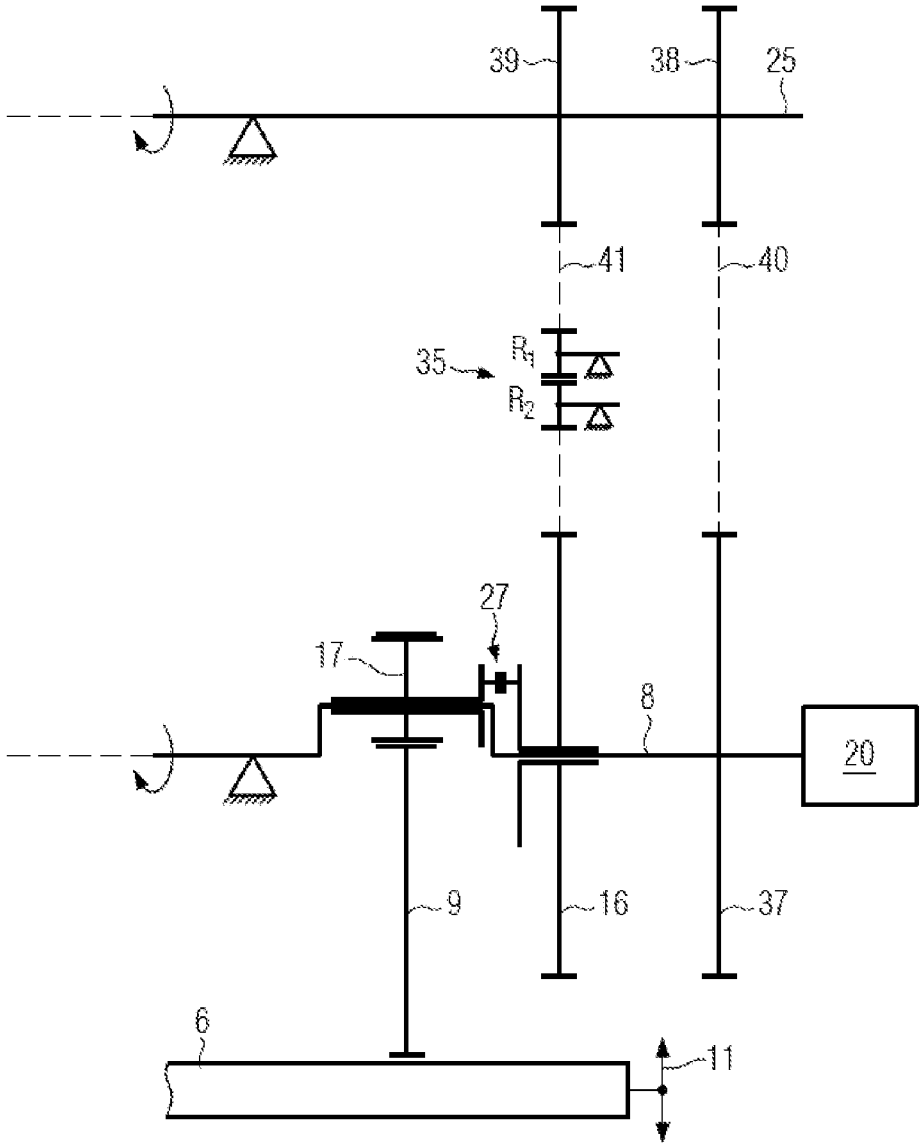
FIG. 3D shows a schematic representation of the second embodiment of FIG. 3 for an individual stroke adjustment.

FIGS. 3C and 3D show variants of the adjusting mechanism 35, the variant shown in FIG. 3C being configured to synchronously adjust a plurality of eccentric bushings 17 mounted along the eccentric shaft 8 (overall stroke adjustment), and the variant represented in FIG. 3D being configured for an individual stroke adjustment at respectively adjacent unit sections of the compacting unit 4.

In FIG. 3C, the adjusting mechanism 35 is mounted between the drive wheel 37 and an adjusting wheel 50. A phase adjustment 26 set by means of the adjusting mechanism 35 in FIG. 3C acts on the adjusting wheel 50 via the synchronous belt 40, wherein the adjusting shaft 31' supporting the adjusting wheel 50 can transmit the torque to further unit sections of the compacting unit 4 synchronously to set eccentric bushings mounted there corresponding to the eccentric bushing 17 of FIG. 3C.

In FIG. 3C, the phase adjustment 26 set by means of the adjusting mechanism 35 is transmitted to the machine element 16 via the two adjusting wheels 50, 51 and the synchronous belt 41, which machine element assumes a corresponding angle of rotation φ on the eccentric shaft 8. The machine element 16 is connected to the eccentric bushing 17 via the claw clutch 27. The phase adjustment 26 set at the machine element 16 is thereby transmitted to the eccentric bushing 17, based on which the desired tamper stroke 11 can be set.

The schematic representation of FIG. 3D shows that the adjusting mechanism 35 is arranged according to FIG. 3, that means it can generate the phase adjustment 26 between the drive wheel 39 and the machine element 16. According to FIG. 3D, for each unit section of the compacting unit 4, a separate adjusting mechanism 35 can be arranged, so that the respective tamper strokes 11 of the unit sections can be activated independently.

What is claimed is:

1. A road finishing machine with a screed for producing a paving layer, wherein the screed includes a compacting unit for precompacting paving material supplied to the screed, wherein the compacting unit includes an eccentric bushing mounted on an eccentric shaft, wherein the eccentric bushing is rotatable relative to the eccentric shaft to a desired angle of rotation to thereby continuously variably set a desired tamper stroke of a tamper bar of the compacting unit, and wherein for rotating the eccentric bushing relative to the eccentric shaft, an adjusting mechanism mounted spaced apart from the eccentric shaft and at least partially rotatable along with a rotary motion of the eccentric shaft is activatable.

2. The road finishing machine according to claim 1, wherein the adjusting mechanism comprises an adjusting drive that can be activated for rotating the eccentric bushing and which is rotationally driven by means of the rotary motion of the eccentric shaft as such, and/or an adjusting transmission that can be activated for rotating the eccentric bushing and is rotationally driven by means of the rotary motion of the eccentric shaft.

3. The road finishing machine according to claim 2, wherein the adjusting drive and/or the adjusting transmission can be activated to adjust an angle of rotation of a machine element rotatably mounted on the eccentric shaft.

4. The road finishing machine according to claim 3, wherein the machine element itself forms the eccentric bushing or is connected to the eccentric bushing by means of a positive clutch.

5. The road finishing machine according to claim 3, wherein at least one further machine element is provided which is embodied for transmitting a rotary motion of the eccentric shaft to the adjusting drive and/or the adjusting transmission.

6. The road finishing machine according to claim 2, wherein during an operation of the compacting unit, the adjusting drive and/or the adjusting transmission are/is rotationally driven at a same speed or at a speed different from that of the eccentric shaft.

7. The road finishing machine according to claim 2, wherein the adjusting drive and/or the adjusting transmission are/is actuatable hydraulically, electrically and/or mechanically.

8. The road finishing machine according to claim 2, wherein the adjusting drive includes an activatable servomotor, and/or a servomotor is provided for the adjusting transmission.

9. The road finishing machine according to claim 2, wherein the adjusting mechanism comprises the adjusting transmission, and the adjusting transmission is embodied as a cam mechanism and/or includes a pair of rotatable deflection rollers.

10. The road finishing machine according to claim 9, wherein the adjusting transmission comprises the pair of rotatable deflection rollers, and the pair of rotatable deflection rollers is movably mounted transverse to the eccentric shaft for rotating the eccentric bushing on the eccentric shaft.

11. The road finishing machine according to claim 2, wherein the compacting unit comprises a plurality of the eccentric bushings rotationally mounted along the eccentric shaft, and wherein the adjusting mechanism is embodied for synchronously adjusting the plurality of the eccentric bushings, or the adjusting mechanism comprises a plurality of the adjusting drives and/or a plurality of the adjusting transmissions for separately adjusting the plurality of the eccentric bushings.

12. The road finishing machine according to claim 2, wherein the adjusting drive and/or the adjusting transmission are/is activatable for setting the desired angle of rotation of the eccentric bushing by means of a controlling system.

13. The road finishing machine according to claim 12, wherein the controlling system includes, for a dynamic adaption of the angle of rotation of the eccentric bushing, at least one control loop for responding to at least one process parameter detectable during operation of the road finishing machine.

14. The road finishing machine according to claim 2, wherein the adjusting mechanism comprises at least one sensor unit which is embodied for detecting a set angle of rotation of the eccentric bushing on the eccentric shaft supporting the same and/or for detecting a tamper stroke of the tamper bar.

15. A method for a continuously variable tamper stroke adjustment at a compacting unit of a road finishing machine, the method comprising: rotating an eccentric bushing relative to an eccentric shaft on which the eccentric bushing is mounted to adjust tamper stroke, wherein for rotating the eccentric bushing relative to the eccentric shaft, an adjusting mechanism mounted at a distance to the eccentric shaft and at least partially rotating along with a rotary motion of the eccentric shaft is activated.

16. The method according to claim 15, wherein the adjusting mechanism comprises an adjusting transmission that is activatable for rotating the eccentric bushing and is rotationally driven by the rotary motion of the eccentric shaft.

17. The method according to claim 15, wherein the compacting unit comprises a plurality of the eccentric bushings rotationally mounted along the eccentric shaft, and the adjusting mechanism is operable to synchronously adjust the plurality of the eccentric bushings.

18. The method according to claim 15, further comprising setting a desired angle of rotation of the eccentric bushing by a controlling system, wherein the controlling system includes, for a dynamic adaption of the angle of rotation of the eccentric bushing, at least one control loop for responding to at least one process parameter detectable during operation of the road finishing machine.

19. A method according to claim 15, wherein the adjusting mechanism comprises at least one sensor unit that is configured to detect a set angle of rotation of the eccentric bushing on the eccentric shaft and/or to detect a tamper stroke of the tamper bar.

20. A road finishing machine comprising:

a screed for producing a paving layer, the screed comprising a compacting unit for precompacting paving material supplied to the screed, wherein the compacting unit includes:

a tamper bar;

an eccentric shaft;

an eccentric bushing mounted on the eccentric shaft, wherein the eccentric bushing is rotatable relative to the eccentric shaft to a desired angle of rotation to thereby variably set a desired tamper stroke of the tamper bar; and an adjustment mechanism mounted spaced apart from the eccentric shaft and at least partially rotatable along with a rotary motion of the eccentric shaft, wherein the adjustment mechanism is activatable to rotate the eccentric bushing relative to the eccentric shaft.

* * * * *